US008010023B2

(12) United States Patent
Murayama et al.

(10) Patent No.: US 8,010,023 B2
(45) Date of Patent: Aug. 30, 2011

(54) DEVELOPING DEVICE, PROCESS CARTRIDGE AND IMAGE FORMING APPARATUS

(75) Inventors: Shin Murayama, Hyogo (JP); Shuichi Nakagawa, Osaka (JP); Ryuji Inoue, Hyogo (JP); Shintaro Yamada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 508 days.

(21) Appl. No.: 12/179,038

(22) Filed: Jul. 24, 2008

(65) Prior Publication Data

US 2009/0041512 A1 Feb. 12, 2009

(30) Foreign Application Priority Data

Aug. 6, 2007 (JP) ..... 2007-204532

(51) Int. Cl.
*G03G 15/08* (2006.01)

(52) U.S. Cl. ..... 399/281; 399/279

(58) Field of Classification Search ..... 399/281, 399/279

See application file for complete search history.

(56) References Cited

U.S. PATENT DOCUMENTS

| | | | | |
|---|---|---|---|---|
| 5,333,040 | A * | 7/1994 | Imamiya | 399/281 |
| 5,557,060 | A * | 9/1996 | Okada et al. | 399/284 |
| 6,064,463 | A * | 5/2000 | Yamada et al. | 355/27 |
| 6,064,847 | A * | 5/2000 | Iwamatsu et al. | 399/283 |
| 6,282,394 | B1 * | 8/2001 | Sakai et al. | 399/281 |
| 2002/0041778 | A1 * | 4/2002 | Muto et al. | 399/281 |
| 2005/0069352 | A1 * | 3/2005 | Nishiwaki | 399/299 |
| 2006/0280529 | A1 | 12/2006 | Nakagawa et al. | |
| 2007/0104523 | A1 | 5/2007 | Yoshida et al. | |
| 2007/0189812 | A1 | 8/2007 | Murayama et al. | |
| 2007/0286647 | A1 * | 12/2007 | Sano et al. | 399/281 |
| 2008/0101823 | A1 | 5/2008 | Katoh et al. | |
| 2008/0131174 | A1 | 6/2008 | Inoue et al. | |
| 2008/0145109 | A1 | 6/2008 | Murayama et al. | |
| 2009/0142677 | A1 * | 6/2009 | Shitara et al. | 430/48 |

FOREIGN PATENT DOCUMENTS

| | | |
|---|---|---|
| JP | 8-76592 | 3/1996 |
| JP | 2987254 | 10/1999 |
| JP | 2001-117366 | 4/2001 |

* cited by examiner

*Primary Examiner* — David M Gray
*Assistant Examiner* — Rodney Bonnette
(74) *Attorney, Agent, or Firm* — Oblon, Spivak, McClelland, Maier & Neustadt, L.L.P.

(57) ABSTRACT

A developing device for developing an electrostatic latent image on an image carrier by supplying a one-component developer to the image carrier. Good images can be obtained over long periods of time, without printing history becoming apparent on account of residual developer. The developing device has a developer carrier that is rotatable and disposed facing an image carrier; and a conductive developer supply and recovery member rotatably arranged so as to abut the developer carrier. The rotation direction of the conductive developer supply and recovery member is opposite to the rotation direction of the developer carrier at a position where the developer carrier and the conductive developer supply and recovery member abut each other. A contact pressure P between the developer carrier and the conductive developer supply and recovery member is set so as to satisfy the relationship 0 (kPa)<P<5.0 (kPa).

17 Claims, 6 Drawing Sheets

FIG. 3

| EVALUATION ITEM | AVERAGE PRESSURE IN CONTACT PORTION BETWEEN DEVELOPER CARRIER AND DEVELOPER SUPPLY AND RECOVERY MEMBER (KPa) | | | | | | | |
|---|---|---|---|---|---|---|---|---|
| | 0.0 | 0.5 | 1.0 | 2.0 | 3.0 | 4.0 | 4.5 | 5.0 |
| DEVELOPING GHOST | × | ○ | ○ | ○ | ○ | ○ | ○ | ○ |
| BACKGROUND FOGGING THROUGH DEVELOPER FILMING ON DEVELOPER CARRIER | ○ | ○ | ○ | ○ | ○ | ○ | ○ | × |
| DRIVING TORQUE | ○ | ○ | ○ | ○ | ○ | ○ | ○ | × |

REMARKS (○:GOOD/×:DEFICIENT)

FIG. 4

| EVALUATION ITEM | MATERIAL IN OUTER PERIPHERY OF DEVELOPER SUPPLY AND RECOVERY MEMBER | | | | |
|---|---|---|---|---|---|
| | CONDUCTIVE RUBBER (NON-FOAMED) | CONDUCTIVE FOAMED RUBBER (EPDM ETC.) | CONDUCTIVE FOAMED URETHANE | CONDUCTIVE BRUSH | METAL SHAFT |
| CONTACT STABILITY WITH DEVELOPPE CARRIER | ○ | ○ | ○ | × | × |
| SUPPLIABILITY OF DEVELOPER TO DEVELOPER CARRIER | × | ○ | ○ | × | × |
| LONG-TERM SHAPE STABILITY | ○ | ○ | ○ | × | ○ |

REMARKS (○:GOOD/×:DEFICIENT)

FIG. 5

| EVALUATION ITEM | Ro/Lsup | | | | | | | | |
|---|---|---|---|---|---|---|---|---|---|
| | 0.10 | 0.15 | 0.20 | 0.25 | 0.30 | 0.35 | 0.40 | 0.45 | 0.50 |
| IMAGE NOISE BY PERMENT DEFORMATION OF DEVELOPER SUPPLY AND RECOVERY MEMBER | ○ | ○ | ○ | ○ | ○ | ○ | ○ | ○ | × |
| CONTACT STABILITY WITH DEVELOPER CARRIER | × | × | ○ | ○ | ○ | ○ | ○ | ○ | ○ |

REMARKS (○:GOOD/×:DEFICIENT)

FIG. 6

| EVALUATION ITEM | AVERAGE CELL COUNT N OF CONDUCTIVE FOAMED ELASTIC MEMBER IN DEVELOPER SUPPLY AND RECOVERY MEMBER (CELLS/25mm) | | | | | | |
|---|---|---|---|---|---|---|---|
| | 20 | 30 | 40 | 50 | 60 | 70 | 80 |
| SUPPLIABILITY OF DEVELOPER TO DEVELOPER CARRIER | ○ | ○ | ○ | × | × | × | × |
| DEVELOPER STIRRABILITY | ○ | ○ | ○ | × | × | × | × |

REMARKS (○:GOOD/×:DEFICIENT)

FIG. 7

| EVALUATION ITEM | PERIPHERAL SPEED RATIO Vsup/Vdev | | | | | | |
|---|---|---|---|---|---|---|---|
| | 0.8 | 1.0 | 1.2 | 1.4 | 1.6 | 1.8 | 2.0 |
| SUPPLIABILITY OF DEVELOPER TO DEVELOPER CARRIER | × | × | ○ | ○ | ○ | ○ | ○ |
| DEVELOPER STIRRABILITY | × | × | ○ | ○ | ○ | ○ | ○ |
| BACKGROUND FOGGING THROUGH DEVELOPER FILMING ON DEVELOPER CARRIER | ○ | ○ | ○ | ○ | ○ | ○ | × |
| DRIVING TORQUE | ○ | ○ | ○ | ○ | ○ | ○ | × |

REMARKS (○:GOOD/ ×:DEFICIENT)

FIG. 8

| EVALUATION ITEM | MATERIAL OF CONDUCTIVE CHARGING MEMBER | | | | |
|---|---|---|---|---|---|
| | CONDUCTIVE NYLON | CONDUCTIVE URTHANE | CONDUCTIVE UHMW POLYETHYLENE | CONDUCTIVE PTFE | CONDUCTIVE PFA |
| BLACK STREAK NOISE IN IMAGE THROUGH FUSION OF DEVELOPER ONTO CONDUCTIVE CHARGING MEMBER | × | △ | × | ○ | ○ |

REMARKS (○:GOOD/ ×:DEFICIENT)

DEVELOPING DEVICE, PROCESS CARTRIDGE AND IMAGE FORMING APPARATUS

BACKGROUND OF THE INVENTION

1. Field of the Invention

The present invention relates to an image forming apparatus such as a copier, facsimile machine, printer, plotter or multifunction machine, and more particularly, to a developing device for developing an electrostatic latent image on an image carrier by supplying a one-component developer to the image carrier, and to a process cartridge provided with the developing device.

2. Description of the Related Art

Conventional developing devices for developing an electrostatic latent image on an image carrier by supplying a one-component developer to the image carrier include the following known technologies.

(1) A developing device (for instance, as disclosed in Japanese Patent No. 2987254) comprising a conductive member (recovery blade) brought into contact with a developer carrier (developing roller) at a position on a downstream side from the position of a part to be developed, with respect to the rotation direction of the developer carrier; and a voltage application means for applying, to the conductive member, a voltage of the same polarity as that of the developer carrier and equal to or above that of the developer carrier.

(2) A developing device (for instance, as disclosed in Japanese Patent Application Laid-open No. 2001-117366) in which developer is electrically supplied and recovered by applying an AC voltage to a developer carrier (developing roller) and applying a DC voltage to a developer supply and recovery member (reset roller).

(3) A developing device (for instance, as disclosed in Japanese Patent No. 3283143) in which, after development, a conductive mesh member, formed by weaving conductive fibers into a mesh, and to which a voltage has been applied, is made to abut a toner layer surface of a developing roller, the mesh member being swingable relative to the developing roller.

In the technology (1), however, good images can be obtained, without printing history becoming apparent, by controlling the electrostatic flocculation state of residual developer after development, to cancel thereby the difference in charge between printed portions and non-printed portions. When the developer becomes harder to charge owing to impaired durability or the like, it is no longer possible to wholly cancel the charge difference between printed and non-printed portions, whereupon printing history may become visible on the image.

Further, in the technology (2), good images can be obtained, without printing history becoming apparent, over long periods of time, by recovering residual developer, after development, by way only of electric forces arising from bias applied between the developer supply and recovery member and the developer carrier. When the amount of charge of the developer drops on account of, for instance, impaired durability or the like, recovery by electric forces may become insufficient, whereupon printing history may become visible on the image.

Furthermore, in the technology (3), good images can be obtained, without printing history becoming apparent, by leveling the developer, after development, using a swingable conductive mesh. However, developer turnover on the developer carrier is difficult by leveling alone, and developer deteriorates more readily on the developer carrier, which may preclude achieving good images over long periods of time.

SUMMARY OF THE INVENTION

In the light of the foregoing, it is an object of the present invention to provide a developing device that allows obtaining stably good images over long periods of time, by preventing the occurrence of ghost noise caused by development history, to provide an image forming apparatus such as a copier, a facsimile machine, a printer, a plotter, a multifunction machine or the like using the developing device, and to provide an image forming method and a process cartridge using the developing device.

In an aspect of the present invention, a developing device comprises a developer carrier that is rotatable and disposed facing an image carrier; a conductive developer supply and recovery member rotatably arranged so as to abut the developer carrier; and a conductive charging member in contact with the developer carrier, at a position further downstream in the rotation direction of the developer carrier than a position at which the developer carrier and the image carrier oppose each other, and further upstream than the abutting position of the developer carrier and the conductive developer supply and recovery member. A DC bias is applied to the conductive charging member in a direction in which regularly-charged developer on the developer carrier moves towards the developer carrier. A DC bias is applied to the conductive developer supply and recovery member in a direction in which regularly-charged developer on the developer carrier moves towards the conductive developer supply and recovery member. The rotation direction of the conductive developer supply and recovery member is opposite to the rotation direction of the developer carrier at a position where the developer carrier and the conductive developer supply and recovery member abut each other. A contact pressure P between the developer carrier and the conductive developer supply and recovery member is set so as to satisfy the relationship $0\ (\text{kPa}) < P < 5.0\ (\text{kPa})$.

In another aspect of the present invention, an image forming apparatus has a developing device. The developing device comprises: a developer carrier that is rotatable and disposed facing an image carrier; a conductive developer supply and recovery member rotatably arranged so as to abut the developer carrier; and a conductive charging member in contact with the developer carrier, at a position further downstream in the rotation direction of the developer carrier than a position at which the developer carrier and the image carrier oppose each other, and further upstream than the abutting position of the developer carrier and the conductive developer supply and recovery member. A DC bias is applied to the conductive charging member in a direction in which regularly-charged developer on the developer carrier moves towards the developer carrier, a DC bias is applied to the conductive developer supply and recovery member in a direction in which regularly-charged developer on the developer carrier moves towards the conductive developer supply and recovery member. The rotation direction of the conductive developer supply and recovery member is opposite to the rotation direction of the developer carrier at a position where the developer carrier and the conductive developer supply and recovery member abut each other. A contact pressure P between the developer carrier and the conductive developer supply and recovery member is set so as to satisfy the relationship $0\ (\text{kPa}) < P < 5.0\ (\text{kPa})$.

In another aspect of the present invention, a process cartridge comprises a developing device and at least an image carrier. The process cartridge removably mounted on an image forming apparatus. The developing device comprises: a developer carrier that is rotatable and disposed facing an image carrier; a conductive developer supply and recovery member rotatably arranged so as to abut the developer carrier; and a conductive charging member in contact with the developer carrier, at a position further downstream in the rotation direction of the developer carrier than a position at which the developer carrier and the image carrier oppose each other, and further upstream than the abutting position of the developer carrier and the conductive developer supply and recovery member. A DC bias is applied to the conductive charging member in a direction in which regularly-charged developer on the developer carrier moves towards the developer carrier, a DC bias is applied to the conductive developer supply and recovery member in a direction in which regularly-charged developer on the developer carrier moves towards the conductive developer supply and recovery member. The rotation direction of the conductive developer supply and recovery member is opposite to the rotation direction of the developer carrier at a position where the developer carrier and the conductive developer supply and recovery member abut each other. A contact pressure P between the developer carrier and the conductive developer supply and recovery member is set so as to satisfy the relationship 0 (kPa)<P<5.0 (kPa).

BRIEF DESCRIPTION OF THE DRAWINGS

The above and other objects, features and advantages of the present invention will become more apparent from the following detailed description taken with the accompanying drawings in which:

FIGS. 3 to 8 are tables summarizing the results of comparative performance evaluations resulting from varying part of the configuration of the developing device.

DESCRIPTION OF THE PREFERRED EMBODIMENT(s)

The present invention is explained in more detail next with reference to accompanying drawings.

Figure 1:
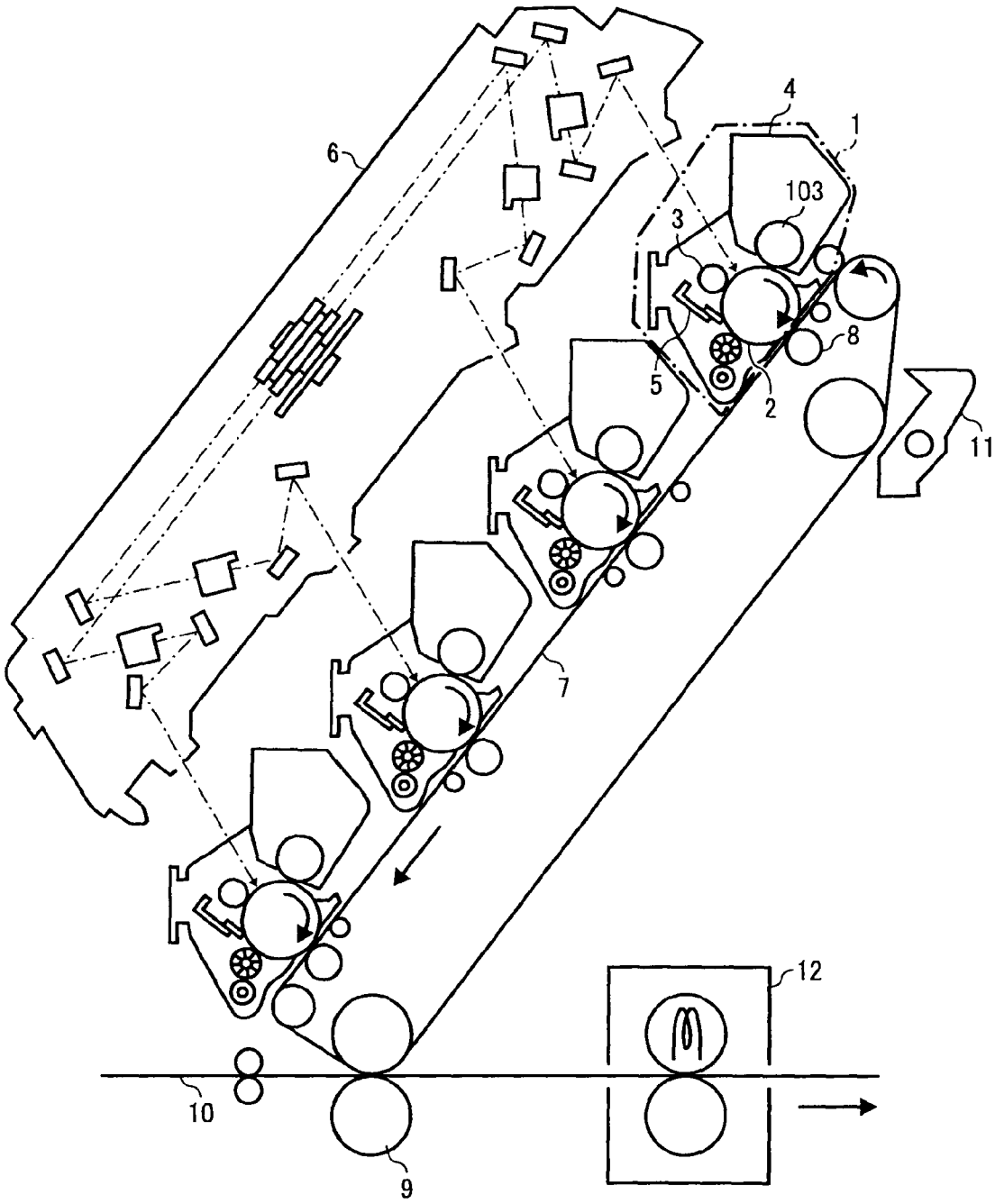
FIG. 1 is a diagram illustrating schematically an image forming apparatus comprising a developing device of the present invention.

FIG. 1 illustrates schematically an image forming apparatus comprising the developing device and the process cartridge unit according to an embodiment of the present invention.

Each of four process cartridge units 1 having identical constitution for respective colors yellow, cyan, magenta and black, comprises a photosensitive drum 2 as an example of an image carrier, a charging member 3, a developing device 4, a cleaning means 5 and so forth, integrated as a single unit. The various above-described units, which are the constituent elements of a respective process cartridge unit 1, are fixed by way of stoppers. The units are replaceable since, by removing the stoppers, the respective units can be individually mounted on, or removed from, the image forming apparatus. Each process cartridge unit 1 need not be provided with all the above-described units, but should comprise the developing device 4 and at least the photosensitive drum 2.

The photosensitive drum 2 rotates in the direction of the arrow. The charging member 3 is brought into pressure contact with the surface of the photosensitive drum 2, and is rotationally driven by the rotation of the photosensitive drum 2. A predetermined bias is applied to the charging member 3 by a high-voltage power supply, not shown, to charge thereby the surface of the photosensitive drum 2.

In the present example there is used contact charging, wherein a roller shaped member (photosensitive drum 2) is charged by being brought into contact with the charging member 3. However, contactless charging may also be employed, wherein the charging member 3 and the photosensitive drum 2 are charged in a contactless fashion.

An exposure means 6 performs exposure by irradiating light, represented by a dot-dash line, onto the photosensitive drum 2 of each process cartridge unit 1, on the basis of image data, to form an electrostatic latent image on the surface of the photosensitive drum 2. In the present example, a laser beam scanner, employing laser diodes, is used as the light source of the exposure means 6, although there may also be used an LED array or the like.

The developing means 4 relies on contact developing using a one-component developer. The electrostatic latent image on the photosensitive drum 2 is developed into an image (hereinafter, toner image) by way of the developer. A predetermined developing bias from a high-voltage power supply, not shown, is applied to a rotatable roller-shaped developer carrier 103 that is disposed facing the photosensitive drum 2, in contact with the latter, in such a manner that the toner image developed on the photosensitive drum 2 is transferred to a below-described intermediate transfer belt 7. The photosensitive member cleaning means 5 cleans the transfer residual toner on the surface of the photosensitive drum 2.

Four process cartridge units 1 for a respective color yellow, cyan, magenta and black, are arranged in the movement direction of the intermediate transfer belt 7, which rotates spanned between support rollers. As a result of this transfer, toner images are formed sequentially superposed on the intermediate transfer belt 7.

A primary transfer roller 8 is disposed at a position opposing the photosensitive drum 2 across from the intermediate transfer belt 7. The photosensitive drum 2 and the primary transfer roller 8 rotate while in contact with the intermediate transfer belt 7.

A high-voltage power supply not shown applies a primary transfer bias between the primary transfer roller 8 and the photosensitive drum 2, whereby the toner image on the surface of the photosensitive drum 2 is transferred onto the surface of the intermediate transfer belt 7. The intermediate transfer belt 7 is rotationally driven, in direction of the arrow in the figure, by a driving motor not shown. A full color image forms by transfer, on the intermediate transfer belt 7, through sequential superposition of the visible images of respective colors from each photosensitive drum 2.

The full color image formed on the intermediate transfer belt 7 is batch-transferred onto paper 10, as a sheet-like medium, at a secondary transfer position that is positioned downstream of the process cartridge unit 1 that is furthest downstream in the rotation direction of the intermediate transfer belt 7.

At the secondary transfer position, a rotatable secondary transfer roller 9 is in contact with the roller that supports the intermediate transfer belt 7. The toner image on the intermediate transfer belt 7 is transferred to the paper 10, as the transfer material, through application of a predetermined voltage between the secondary transfer roller 9 and the intermediate transfer belt 7.

The paper 10, onto which the toner image is transferred, is transported to a fixing device 12, where the image of the developer on the paper 10 is fixed by heat and pressure, after which the paper 10 is outputted to an output section. The developer remaining on the intermediate transfer belt 7 without being transferred onto the secondary transfer roller 9 is recovered by a transfer belt cleaning means 11.

Figure 2:
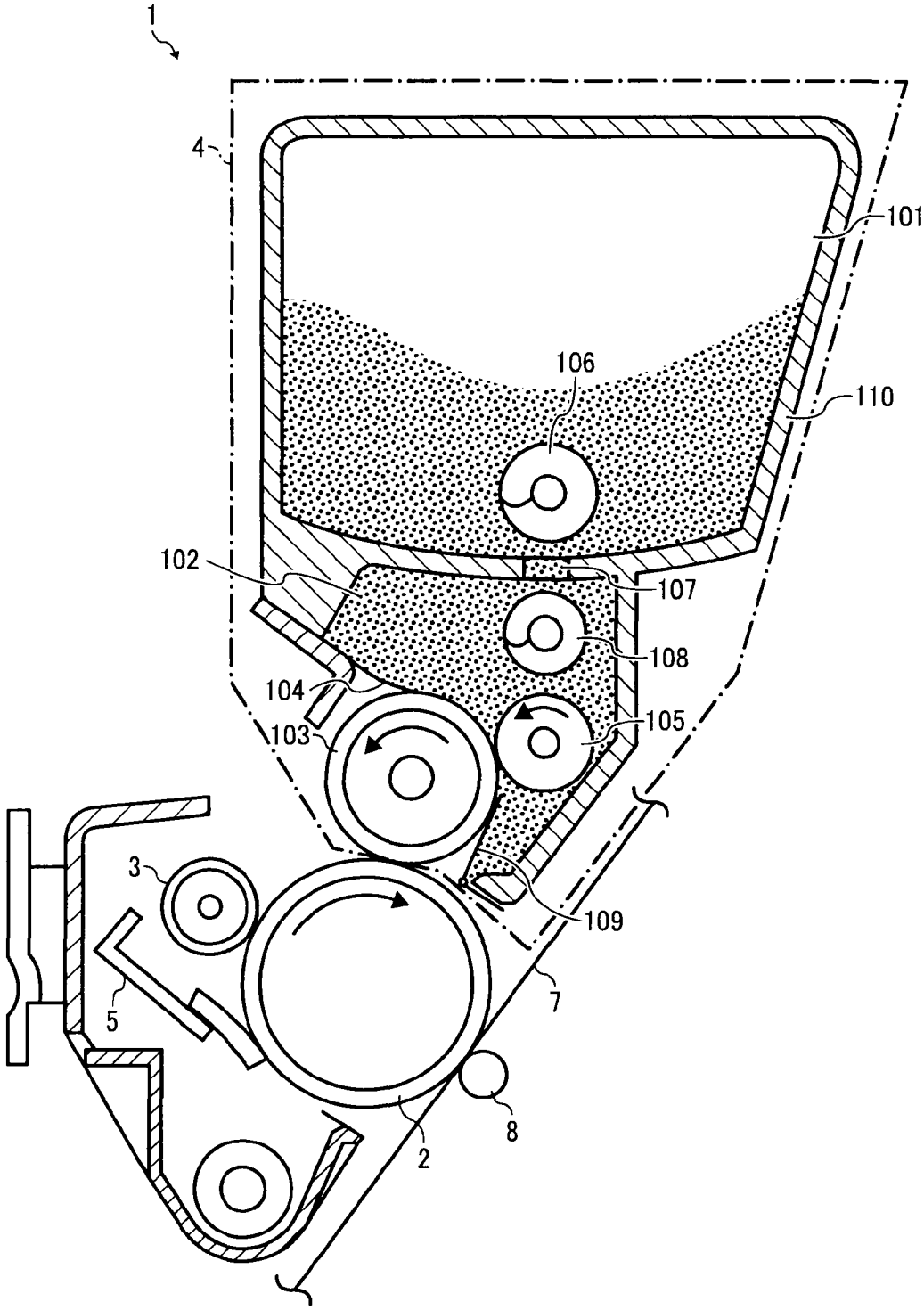
FIG. 2 is a diagram illustrating schematically a process cartridge comprising the developing device.

FIG. 2 illustrates a process cartridge comprising the developing device according to the present embodiment. The developing device 4 comprises a developer storage chamber 101 for storing the developer, and a developer supply chamber 102 provided below the developer storage chamber 101. A partitioning member 110 is provided so as to vertically partition the developer storage chamber 101 from the developer supply chamber 102.

A plurality of spaced-apart openings 107 are formed in the partitioning member 110, in a direction perpendicular to the paper in the figure. Some of the openings 107 function as supply openings for supplying developer from the developer storage chamber 101 to the developer supply chamber 102, while some of the openings 107 function as return openings through which developer returns from the developer supply chamber 102 into the developer storage chamber 101.

On the lower portion of the developer supply chamber 102 there are provided the developer carrier 103, and a layer regulating member 104 and a conductive developer supply and recovery member 105 which abut the developer carrier 103. A developer transport member 106 is provided in the developer storage chamber 101.

The developer transport member 106, which is a member having a rotation shaft that combines a screw shape and a plate shape, is provided above the openings 107 along the longitudinal direction, which is perpendicular to the paper in FIG. 2. The developer transport member 106 is configured so that rotation thereof allows developer to be transported parallelly to the developer transport member 106 in a substantially horizontal direction.

The present example is illustrated with the developer transport member 106 configured so as to transport the developer in a direction parallel to the developer transport member 106, but the latter is not limited thereto. The developer transport member 106 may have a transport function such as a screw, a conveyor belt, a coil-shaped rotary member or the like, which may be combined with a stirring function using, for instance, blade-like paddles of bent wire or plate members. Also, the transport direction of the developer may be such that the developer is transported in the direction of the normal line to the rotation arc of the developer transport member 106.

As described above, the plurality of openings 107, which are provided parallelly to the developer carrier 103, are divided into openings for transporting the developer held in the developer storage chamber 101 into the developer supply chamber 102, and openings for returning to the developer storage chamber 101 the developer supplied in excess into the developer supply chamber 102.

A developer stirring member 108 is provided extending below the openings 107, in the developer supply chamber 102. The developer stirring member 108, which is a member having a rotation shaft that combines a screw shape and a plate shape, is configured so that rotation thereof allows transporting developer along the longitudinal direction of the axis of the developer stirring member 108.

The developer accumulated under the partitioning member 110, at a position below the openings 107 that function as return openings, heaps up in a substantially conical shape. Therefore, the developer stirring member 108 has a blade shape such that the transport direction of the screw of the developer stirring member 108 becomes a reverse direction immediately below the return openings 107.

The developer stirring member 108 piles up the developer into a substantially conical shape and returns the developer to the developer storage chamber 101 via the openings 107. The developer stirring member 108 has the function of stirring the developer in the developer supply chamber 102, and of supplying the developer towards the developer carrier 103 and the developer supply and recovery member 105 provided below the developer stirring member 108.

The developer supply and recovery member 105 has a central metal core that is surrounded by a conductive foamed elastic body. That is, the surface of the developer supply and recovery member 105 is covered by a foamed material the structure of which comprises pores (cells). The developer transported into the developer supply chamber 102 is recovered by becoming adhered efficiently onto the developer supply and recovery member 105. This prevents toner degradation through pressure concentration at the abutting portion with the developer carrier 103. The electric resistance value of the foamed material on the surface of the developer supply and recovery member 105 is set to range from $10^3$ to $10^{14}\Omega$.

A DC bias is applied to a conductive charging member 109 in a direction in which the regularly-charged developer on the developer carrier 103 moves towards the developer carrier 103.

To the developer supply and recovery member 105 there is applied a DC offset voltage, as a recovery bias, to a reverse polarity of the charging polarity of the developer, relative to the potential of the developer carrier 103. This recovery bias has the effect of pulling the residual developer on the developer carrier 103, regularly charged, towards the developer supply and recovery member 105, at a contact portion between the developer carrier 103 and the conductive charging member 109 that is applied a bias in the direction of pulling regularly-charged developer towards the developer carrier 103.

A free end of the conductive charging member 109 is in contact with the developer carrier 103, at a position further downstream in the rotation direction of the developer carrier 103 than the position at which the developer carrier 103 and the photosensitive drum 2 oppose each other, and further upstream than the abutting position of the developer carrier 103 and the conductive developer supply and recovery member 105. The base end of the conductive charging member 109 is fixed to a portion of the developing device 4.

The developer supply and recovery member 105 rotates in the counterclockwise direction (direction in which the heading of the developer supply and recovery member 105 is opposite to the heading of the developer carrier 103 at the contact portion with the developer carrier 103), whereby the developer held on the surface of the developer supply and recovery member 105 is supplied to the surface of the developer carrier 103.

The developer carrier 103 uses a roller covered with an elastic rubber layer, and has provided, on the surface thereof, a surface coat layer comprising a material that is readily chargeable with a reverse polarity to that of the developer. The hardness of the elastic rubber layer is set to be not higher than 50 degrees, in accordance with JIS-A, to maintain a uniform contact with the photosensitive drum 2. The electric resistance value of the elastic rubber layer is set to range from $10^3$ to $10^{14}\Omega$, to allow application of a developing bias. The surface roughness (Ra) of the developer carrier 103 is set to range from 0.2 to 2.0 μm, so that the required amount of developer may be held in the surface of the developer carrier 103.

The developer carrier 103 rotates in the counterclockwise direction, whereupon the developer held in the surface thereof is transported up to the opposing position of the layer regulating member 104 and the photosensitive drum 2. The layer regulating member 104 uses a metal-plate spring material such as SUS304 CSP, SUS301 CSP, phosphor bronze or the like. The free end of the layer regulating member 104 abuts the surface of the developer carrier 103 with a pressing force of 10 to 100 N/m. As a result, the developer passing under that pressing force is made into a thin layer while being charged through friction charging.

To assist friction charging, a voltage of the same polarity as the charging polarity of the developer, offset relative to the potential applied to the developer carrier 103, is further applied, as regulating bias, to the layer regulating member 104.

The photosensitive drum 2 rotates clockwise. At the opposing position of the developer carrier 103 and the photosensitive drum 2, therefore, the surface of the developer carrier 103 moves in the same direction as the photosensitive drum 2.

The developer made into a thin layer on the developer carrier 103 is transported, on account of the rotation of the developer carrier 103, up to the opposing position of the developer carrier 103 and the photosensitive drum 2. The developer migrates to the surface of the photosensitive drum 2, for development, in accordance with the developing bias applied to the developer carrier 103 and the latent image electric field formed by the electrostatic latent image on the photosensitive drum 2.

The conductive charging member 109 is provided abutting the developer carrier 103 at the portion where developer remaining on the developer carrier 103 returns again to the developer supply chamber 102 without having being supplied, for developing, to the photosensitive drum 2. The conductive charging member 109 prevents thus developer from leaking out of the developing device 4, and furthermore charges the residual developer with regular polarity.

FIG. 3 summarizes the results for three evaluation items relating to average pressure in the contact portion between the developer carrier 103 and the developer supply and recovery member 105. When the developer carrier 103 and the developer supply and recovery member 105 are not in contact, i.e. when the contact pressure P is 0 (kPa), then the bias applied between the developer carrier 103 and the developer supply and recovery member 105 has little effect, and recovery of developer after developing is insufficient, which results in ghost noise on account of the developing history.

On the other hand, when the contact pressure P is set to 5.0 (kPa) or higher, the driving torque increases, which pushes up costs and makes driving noise, such as jitter, likelier to be made apparent on the image. Also, the sliding friction heat generated at the contact portion between the developer carrier 103 and the developer supply and recovery member 105 promotes filming of the developer on the developer carrier 103, and gives rise to problems such as background fogging and the like. Setting the contact pressure P to 0 (kPa)<P<5.0 (kPa) allows inhibiting the generation sliding friction heat while maintaining an adequate contact between the developer carrier 103 and the developer supply and recovery member 105. The residual developer after developing is thus electrically recovered with reduced stress on the developer, and hence good images can be achieved, free of developing ghost or afterimages, over long periods of time.

FIG. 4 summarizes the results on three evaluation items relating to the material of the developer supply and recovery member 105. When using non-foamed conductive rubber as the material covering the metal core (leftmost column in the material column in FIG. 4), the surface has no cells where the developer can be held, and it is thus difficult to supply developer efficiently to the developer carrier 103.

When using a conductive brush as the developer supply and recovery member 105 (second column from the right in the material column in FIG. 4), the developer supply and recovery member 105 is normally in contact with the developer carrier 103, and hence brush bristles tend to slant, thereby impairing contact stability and precluding the developer from being continuously supplied to the developer carrier 103 with good efficiency.

When using a metal core (metal shaft) alone (rightmost column in the material column in FIG. 4), shape is stable over long periods of time, but with impaired stability of contact with the developer carrier 103 and supply of developer to the developer carrier 103.

When using a central metal core covered with a conductive foamed rubber or a conductive foamed urethane (second and third columns from the left in the material column in FIG. 4), as the developer supply and recovery member 105, distortion characteristics improve comparatively, developer is readily held in the cells (pores) in the surface of the developer supply and recovery member 105, and developer can be efficiently supplied to the developer carrier 103. Good images can be obtained thereby over long periods of time.

That is, the outer periphery of the developer supply and recovery member 105 is covered by a conductive foamed elastic body, whereby bias can be appropriately applied to the developer supply and recovery member 105, and the latter can remain stably in contact with the developer carrier 103. Moreover, the foamed cells on the periphery of the developer supply and recovery member 105 allow developer to be transferred mechanically, with good efficiency, onto the developer carrier 103. As a result, good noise-free images can be obtained over long periods of time.

FIG. 5 summarizes the results for two evaluation items, namely "image noise caused by permanent deformation of the developer supply and recovery member" and "contact stability with the developer carrier" relating to the deformation rate Rc/Lsup of an elastic member, based on the amount of deformation Rc in the radial direction of the developer supply and recovery member 105 at the abutting position of the developer carrier 103 and the developer supply and recovery member 105, and the wall thickness Lsup of the conductive foamed elastic body of the developer supply and recovery member 105.

FIG. 5 shows that setting the deformation rate Rc/Lsup to lie within 0.15<Rc/Lsup<0.50 allows the developer carrier 103 and the developer supply and recovery member 105 to be normally in contact, without permanent deformation problems, so that good images can be obtained over long periods of time.

That is, contact between the developer carrier 103 and the developer supply and recovery member 105 can be kept stable by setting the Rc/Lsup to be greater than 0.15, while deformation of the outer periphery of the developer supply and recovery member 105 can be prevented by setting Rc/Lsup to be smaller than 0.50. As a result, contact between the developer carrier 103 and the developer supply and recovery member 105 can be kept stable over long periods of time, while noise-free good images can be likewise obtained over long periods of time.

FIG. 6 summarizes the results for two evaluation items, namely "suppliability of developer to the developer carrier" and "developer stirrability" relating to the average cell count N (cells/25 mm) of the conductive foamed elastic member comprised in the developer supply and recovery member 105. Good results were obtained for an average cell count of 20 (cells/25 mm), an average cell count of 30 (cells/25 mm), and an average cell count of 40 (cells/25 mm). An average cell count of 50 (cells/25 mm) or higher is unfeasible. In terms of data, good results were obtained when the relationship $20 \leqq N < 50$ (cells/25 mm) is satisfied.

The reason for the good results obtained is that reducing the cell count allowed increasing the cell diameter, and enhancing as well the stirrability of the developer, and therefore, it was possible to suppress developer accumulation while preserving the suppliability of the developer. This enabled good images to be obtained over long periods of time. The good results arise also from the relatively rough surface of the developer supply and recovery member 105, which makes it possible to transport the developer mechanically, with better efficiency, from the periphery of the developer supply and recovery member 105 onto the developer carrier 103.

FIG. 7 summarizes the results for four evaluation items, namely "suppliability of developer to the developer carrier", "developer stirrability", "background fogging on account of developer filming on the developer carrier" and "driving torque" relating to a ratio Vsup/Vdev of the peripheral speed Vdev of the developer carrier 103 an the peripheral speed Vsup of the developer supply and recovery member 105.

When Vsup/Vdev is 0.8 and 1.0, "suppliability of developer to the developer carrier" and "developer stirrability" are deficient. When Vsup/Vdev is 2.0, "background fogging on account of developer filming on the developer carrier" and "driving torque" are deficient. All evaluation items are good when Vsup/Vdev is "1.2", "1.4", "1.6" and "1.8".

Setting the range $1.0 < Vsup/Vdev < 2.0$ enables sufficient supply of developer to the developer carrier 103 while reducing driving torque and curbing developer filming on the developer carrier 103. Good images can be obtained as a result over long periods of time.

That is, setting a range $Vsup/Vdev > 1.0$ allows more developer to be transported, per time unit, to the developer carrier 103. Meanwhile, setting a range $Vsup/Vdev < 2.0$ allows curbing the generation of sliding friction heat at the abutting portion of the developer carrier 103 and the developer supply and recovery member 105, while reducing stress on the developer. Good noise-free images can be obtained as a result over long periods of time.

FIG. 8 summarizes the results of using various sheet materials for the evaluation item "developer melting and associated occurrence of black streaks", relating to the material of the conductive charging member 109, over which residual developer passes, in physical contact with the conductive charging member 109, after development. In the results, "conductive nylon" was deficient, while "conductive urethane" resulted in developer fusion onto the charging member, with slight black streaking. Conductive nylon and conductive urethane are thus best avoided. When using a conductive charging member in which carbon is dispersed in a conductive fluororesin typified by, for instance, "conductive PTFE", "conductive PFA" or the like, there occurred no developer fusion, and naturally no noise resulting therefrom, such as black streaks or the like, which made it thus possible to obtain good images over long periods of time. The conductive charging member comprising a conductive fluororesin has high releasability, which allowed preventing fusion of the developer onto the conductive charging member.

The developer used in the present example is a non-magnetic one-component developer containing a wax. No oil application is necessary during fixing, and thus the fixing device can be a simple one that, besides, requires no carrier or the like. The device, therefore, can be made simple, incurring fewer costs, while enhancing ease of handling by the user.

By virtue of the above features, an image forming apparatus comprising the above developing device 4 allows thus obtaining good images over long periods of time.

The process cartridge comprising the developing device 4 and at least the photosensitive drum 2 can be easily mounted on, and removed from, an image forming apparatus. This enhances, as a result, ease of handling by the user.

The present invention, therefore, succeeds in providing a developing device that allows obtaining stably good images over long periods of time, an image forming apparatus such as a copier, a facsimile machine, a printer, a plotter, a multifunction machine or the like using the developing device, as well as a process cartridge using the developing device.

Various modifications will become possible for those skilled in the art after receiving the teachings of the present disclosure without departing from the scope thereof.

What is claimed is:

1. A developing device, comprising:

a developer carrier that is rotatable and disposed facing an image carrier;

a conductive developer supply and recovery member rotatably arranged so as to abut the developer carrier with a contact pressure P between the developer carrier and the conductive developer supply and recovery member satisfying the relationship $0\ (kPa) < P < 5.0\ (kPa)$, the conductive developer supply and recovery member being charged with a DC bias to move regularly-charged developer on the developer carrier in a direction towards the conductive developer supply and recovery member; and a conductive charging member in contact with the developer carrier, at a position further downstream in the rotation direction of the developer carrier than a position at which the developer carrier and the image carrier oppose each other, and further upstream than the abutting position of the developer carrier and the conductive developer supply and recovery member, the conductive charging member being charged with a DC bias in a direction in which the regularly-charged developer on the developer carrier moves towards the developer carrier, to charge developer that remains on the developer carrier without having been supplied for developing after returning from the position at which the developer carrier and the image carrier oppose each other as the regularly-charged developer, a rotation direction of the conductive developer supply and recovery member being opposite to a rotation direction of the developer carrier at a position where the developer carrier and the conductive developer supply and recovery member abut each other.

2. The developing device as claimed in claim 1, wherein the conductive developer supply and recovery member includes a metal core in the center thereof, and a conductive foamed elastic body in the outer periphery thereof.

3. The developing device as claimed in claim 2, wherein an amount of deformation Rc in the radial direction of the conductive developer supply and recovery member at the abutting position of the developer carrier and the conductive developer supply and recovery member, and a wall thickness Lsup of the conductive foamed elastic body of the conductive developer supply and recovery member, satisfy the relationship $0.15 < Rc/Lsup < 0.50$.

4. The developing device as claimed in claim 2 or 3, wherein an average cell count N of the conductive foamed elastic body of the conductive developer supply and recovery member satisfies the relationship $20 \leqq N < 50$ (cells/25 mm).

5. The developing device as claimed in claim 2, wherein an electric resistance value of the conductive foamed elastic body of the conductive developer supply and recovery member is set to range from $10^3$ to $10^{14}\Omega$.

6. The developing device as claimed in claim 1, wherein a peripheral speed Vdev of the developer carrier and a peripheral speed Vsup of the conductive developer supply and recovery member satisfy the relationship $1.0<Vsup/Vdev<2.0$.

7. The developing device as claimed in claim 1, wherein the conductive charging member includes a conductive sheet in which carbon is dispersed in a fluororesin.

8. The developing device as claimed in claim 1, wherein a non-magnetic one-component developer containing a wax is used as the developer.

9. The developing device as claimed in claim 1, further comprising:

a layer regulating member that abuts the developer carrier with a pressing force of 10 to 100 N/m, at a position further downstream in the rotation direction of the developer carrier than the abutting position of the developer carrier and the conductive developer supply and recovery member, and that charges developer passing under the pressing force through friction charging.

10. The developing device as claimed in claim 9, wherein the layer regulating member is charged with a regulating bias of the same polarity as a charging polarity of the regularly-charged developer, the regulating bias being offset relative to a developing bias that the developer carrier is charged with.

11. The developing device as claimed in claim 1, further comprising:

a developer stirring member provided above the conductive developer supply and recovery member in a developer supply chamber of the developing device, the developer stirring member supplying developer towards the developer carrier and the conductive developer supply and recovery member, and the developer stirring member returning developer that piles up in the developer supply chamber to a developer storage chamber of the developing device through return openings of a partitioning member, the partitioning member dividing the developer supply chamber to be below the developer storage chamber.

12. The developing device as claimed in claim 1, wherein a surface roughness Ra of the developer carrier is set to range from 0.2 to 2.0 μm.

13. The developing device as claimed in claim 1, wherein the developer carrier includes a roller covered with an elastic rubber layer that has a hardness set to be not higher than 50 degrees, in accordance with JIS-A.

14. The developing device as claimed in claim 13, wherein a surface of the elastic rubber layer is provided with a surface coat layer made of a material that is readily chargeable with a reverse polarity to that of the developer.

15. The developing device as claimed in claim 13, wherein an electric resistance value of the elastic rubber layer is set to range from $10^3$ to $10^{14}\Omega$.

16. An image forming apparatus, comprising:

a developing device, wherein the developing device includes a developer carrier that is rotatable and disposed facing an image carrier;

a conductive developer supply and recovery member rotatably arranged so as to abut the developer carrier with a contact pressure P between the developer carrier and the conductive developer supply and recovery member satisfying the relationship $0\ (kPa)<P<5.0\ (kPa)$, the conductive developer supply and recovery member being charged with a DC bias to move regularly-charged developer on the developer carrier in a direction towards the conductive developer supply and recovery member; and a conductive charging member in contact with the developer carrier, at a position further downstream in the rotation direction of the developer carrier than a position at which the developer carrier and the image carrier oppose each other, and further upstream than the abutting position of the developer carrier and the conductive developer supply and recovery member, the conductive charging member being charged with a DC bias in a direction in which the regularly-charged developer on the developer carrier moves towards the developer carrier, to charge developer that remains on the developer carrier without having been supplied for developing after returning from the position at which the developer carrier and the image carrier oppose each other as the regularly-charged developer, a rotation direction of the conductive developer supply and recovery member being opposite to a rotation direction of the developer carrier at a position where the developer carrier and the conductive developer supply and recovery member abut each other.

17. A process cartridge, comprising:

a developing device and at least an image carrier, and the process cartridge removably mounted on an image forming apparatus, wherein the developing device includes a developer carrier that is rotatable and disposed facing an image carrier;

a conductive developer supply and recovery member rotatably arranged so as to abut the developer carrier with a contact pressure P between the developer carrier and the conductive developer supply and recovery member satisfying the relationship $0\ (kPa)<P<5.0\ (kPa)$, the conductive developer supply and recovery member being charged with a DC bias to move regularly-charged developer on the developer carrier in a direction towards the conductive developer supply and recovery member; and a conductive charging member in contact with the developer carrier, at a position further downstream in the rotation direction of the developer carrier than a position at which the developer carrier and the image carrier oppose each other, and further upstream than the abutting position of the developer carrier and the conductive developer supply and recovery member, the conductive charging member being charged with a DC bias in a direction in which the regularly-charged developer on the developer carrier moves towards the developer carrier, to charge developer that remains on the developer carrier without having been supplied for developing after returning from the position at which the developer carrier and the image carrier oppose each other as the regularly-charged developer, a rotation direction of the conductive developer supply and recovery member being opposite to a rotation direction of the developer carrier at a position where the developer carrier and the conductive developer supply and recovery member abut each other.

* * * * *